US006662407B2

(12) United States Patent
Bernhardt et al.

(10) Patent No.: US 6,662,407 B2
(45) Date of Patent: Dec. 16, 2003

(54) METHOD AND APPARATUS FOR MANUFACTURING A FIBER FLEECE

(75) Inventors: Siegfried Bernhardt, Bremen (DE); Johann Philipp Dilo, Eberbach (DE); Joachim Leger, Eberbach (DE); Ulrich Wolf, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 0 days.

(21) Appl. No.: 10/218,778

(22) Filed: Aug. 14, 2002

(65) Prior Publication Data

US 2003/0033691 A1 Feb. 20, 2003

(30) Foreign Application Priority Data

Aug. 14, 2001 (DE) ..... 101 39 833

(51) Int. Cl.[7] ..... D04H 5/08
(52) U.S. Cl. ..... 19/161.1; 19/163
(58) Field of Search ..... 19/65 A, 151, 19/296, 301, 160, 161.1, 163

(56) References Cited

U.S. PATENT DOCUMENTS

| | | | | |
|---|---|---|---|---|
| 314,369 A | * | 3/1885 | Dolge | 19/161.1 |
| 3,474,502 A | * | 10/1969 | Pohland | 19/161.1 |
| 5,400,475 A | * | 3/1995 | Hille | 19/163 |
| 5,590,442 A | * | 1/1997 | Hirschek et al. | 19/163 |
| 5,802,674 A | | 9/1998 | Barber | |
| 6,189,185 B1 | * | 2/2001 | Bioul et al. | 19/163 |
| 6,195,844 B1 | * | 3/2001 | Jourde et al. | 19/163 |
| 6,434,795 B1 | * | 8/2002 | Jourde et al. | 19/161.1 |

FOREIGN PATENT DOCUMENTS

| | | | | |
|---|---|---|---|---|
| DE | 22 59 919 | | 6/1974 | |
| DE | 32 45 517 | | 6/1984 | |
| DE | 3503447 | * | 8/1985 | D02G/1/14 |
| DE | 40 10 174 | | 10/1991 | |
| DE | 43 04 988 | | 4/1994 | |
| FR | 2 770 885 | | 5/1999 | |
| FR | 2 794 475 | | 12/2000 | |

* cited by examiner

*Primary Examiner*—Gary L. Welch
(74) *Attorney, Agent, or Firm*—Jansson, Shupe & Munger, Ltd

(57) ABSTRACT

In the manufacture of a fiber fleece with a nonwoven producing means and a fleece laying machine, which produces from a single or multi-layered nonwoven web contionuously discharged by the nonwoven producing means a fleece web having a thickness variable across the laying width, the nonwoven web is cyclically drawn on the way between the nonwoven producing means and the fleece laying machine at a fixedly determined location, said drawing depending on the laying movements of the fleece laying machine to form a fleece web of a regular cross sectional profile. Between a separate drawing equipment performing the drawing process and the inlet into the fleece laying machine, the nonwoven web may run through a separate, variable buffer storage, which adapts the speed fluctuations of the nonwoven web on the outlet side of the drawing equipment to the intake speed of the fleece laying machine. The fleece laying machine can be formed without its own buffer storage, since the separate buffer storage may also compensate the transport speed fluctuations of the nonwoven web required by the laying movements.

26 Claims, 5 Drawing Sheets

METHOD AND APPARATUS FOR MANUFACTURING A FIBER FLEECE

FIELD OF THE INVENTION

Figure 1:
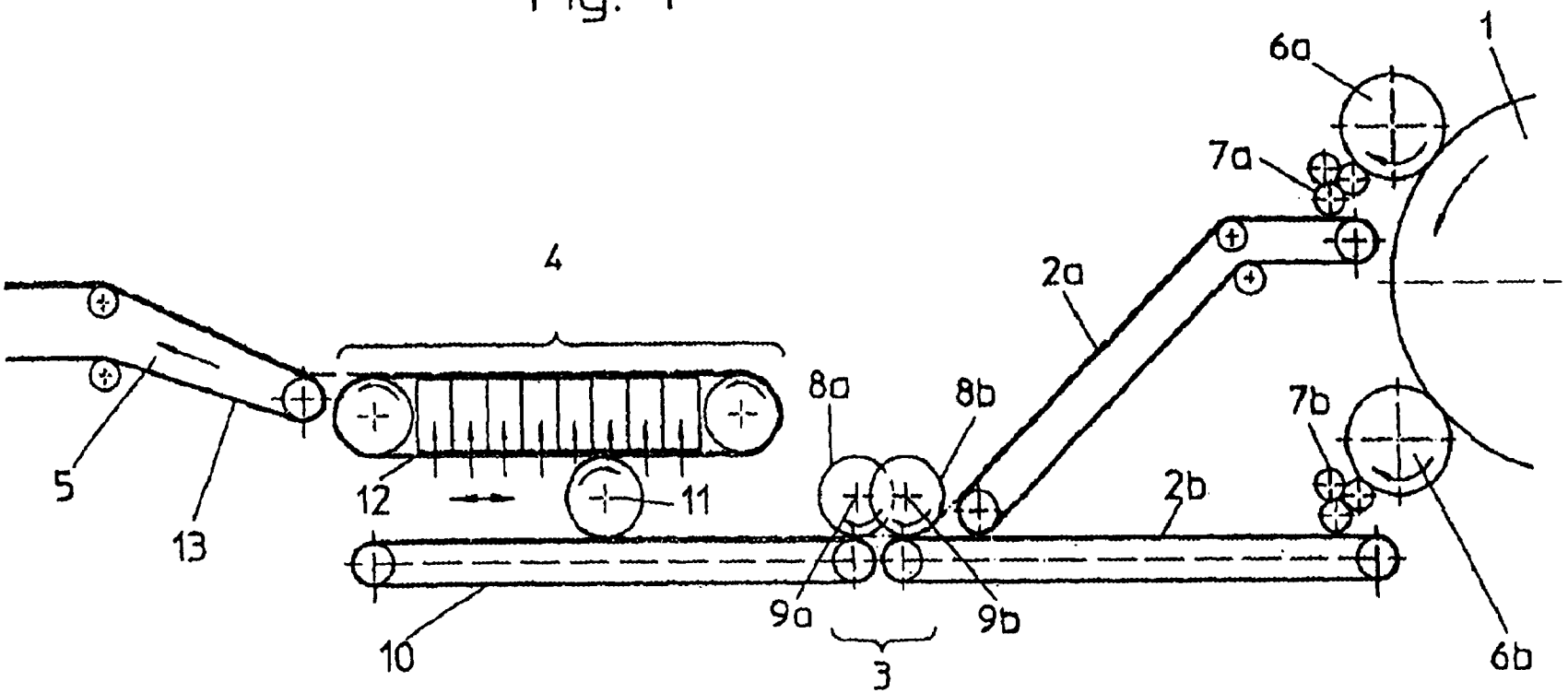

The present invention refers to a method and an apparatus for manufacturing a fiber fleece by a fiber web producing means and a fleece laying machine, which is forming a cross lapped fleece web from a single or multi-layered fiber web continuously output by the fiber web producing means, said cross lapped fleece web having a thickness varying over the laying width.

BACKGROUND ART

A methods and an apparatus of this type are known from DE 43 04 988 C1. The aim of them is to generate a cross lapped fleece web having a uneven thickness profile when seen transversely to the fleece web direction, in that the thickness of the web is smaller in the rim portions than in the center of the web. The reason for this is that during the treatment of the fleece web in a needling machine, the fleece web is laterally drawing-in by the needling process, i.e. it becomes narrower, whereas at the same time the thickness profile changes. From a fleece web having an regular thickness and supplied to the needling machine, the latter generates a felt web being thicker on its rim portions than in its center. In order to eliminate this irregularity, a cross lapped fleece web supplied to the needling machine has a thickness profile in the transverse direction of the web which, starting from the center, becomes gradually smaller towards the rim portions of the web.

Different methods exist how a fleece web can be generated from a fiber web output by a carding machine, said fleece web seen in cross section transversely to the longitudinal extension of the web has an irregular thickness profile of the aforementioned kind. DE 40 10 174 A1 describes a fleece laying apparatus in which a temporary storage is formed in the nonwoven by de-coupling the movement of the laying carriage with respect to the nonwoven suppliers, said storage enabling a variable nonwoven deposition at the outlet of the fleece laying apparatus onto an outlet belt. Within a movement cycle of the fleece laying machine with forward and backward motion of the laying carriage, the fleece laying machine lays as much nonwoven as it is supplied during the same time by the nonwoven producing means. However, it is possible within the laying cycle to let more or less nonwoven emerge at the laying carriage. The mechanical effort and the control effort of such a fleece laying machine is, however, enormous.

DE43 04988 C1 describes a method in which the nonwoven is expanded or upset by a controlled uniform raising or lowering of the speed level of the drives conducting the nonwoven in the fleece laying machine compared to the output speed of the nonwoven producing means. The nonwoven exiting from a carding machine is running at constant speed over a supply belt driven at constant speed to the fleece laying machine whose nonwoven intake speed is varied depending on the movements of the laying carriage of the machine. This leads to a cyclic tensioning and a cyclic upsetting of the nonwoven web entering the fleece laying machine with resulting thinnings and thickenings of the nonwoven. However, only the cyclic timing of the generation of thickenings and thinnings in the nonwoven is fixedly coupled with the motion of the laying carriage. The local cycle or repeating of the thickenings and thinnings in the nonwoven is not defined in the same manner, since the portions at which thickenings and thinnings are produced are not unambiguously defined by the type of device. The tension produced by the drawing action is effective in the entire portion of the nonwoven lying on the supply belt between the carding machine and the fleece laying machine, and is especially effective at locations where thin portions are already existent in the nonwoven. Thus, it is not guaranteed that the thin portions are deposited by the fleece laying apparatus exactly at locations on the output belt where they should be deposited.

A method is known from FR 2 794 475 A1, in which depending on the cross sectional profile of a laid fleece web or a felt manufactured therefrom, the carding machine arranged in front of the fleece laying machine is controlled to generate a nonwoven web with distributed thin and thick portions. The disadvantage of this procedure is that it must be acted on relatively large moved masses, which requires high power control and drive means.

SUMMARY OF THE INVENTION

It is the object of the present invention to provide a method of the above-mentioned kind and a device suitable for performing same, which allow the deposition of a fleece web of a desired cross sectional profile.

To solve this object, the invention provides a method of manufacturing a fiber fleece by means of a nonwoven producing means and a fleece laying apparatus, which produces a fleece web from a single or multi-layered nonwoven web continuously supplied with a constant supply speed by the nonwoven producing means, said fleece web having a thickness variable across a laying width, in which method an intake speed at which the fleece laying apparatus accepts the nonwoven web is constant and the nonwoven web is longitudinally drawn in a drawing process on its way between the nonwoven producing means and the fleece laying machine cyclically in adaptation to laying movements of the fleece laying machine, wherein before or after the drawing process or before and after the drawing process a buffering of the nonwoven web takes place to adapt fluctuations of the nonwoven web speed caused by the drawing process to the supply and intake speeds of the nonwoven producing means and of the fleece laying machine, respectively.

A device according to the invention for manufacturing a fiber fleece from a nonwoven web, which is continuously output by a nonwoven producing means and supplied to a fleece laying machine, provides that the fleece laying machine is driven at a constant nonwoven intake speed, that a controllable drawing equipment is arranged between the nonwoven producing means and the fleece laying machine, through which said drawing equipment the nonwoven web is passed, said drawing equipment being adapted to draw the nonwoven web in the longitudinal direction, and that means are provided which depending on the laying movements of the fleece laying machine act on the drawing equipment in the sense of a cyclic change of the drawing effect exerted onto the nonwoven web, and that buffer storage means are provided, which are arranged between the drawing equipment on the one hand and the fleece laying machine or the nonwoven producing means on the other hand, or between the drawing equipment on the one hand and both of the fleece laying machine and the nonwoven producing means on the other hand.

Thus, the invention provides that a drawing process between the nonwoven production and the passing-on of the nonwoven web to the fleece laying machine is carried out at a defined location in the transport path of the nonwoven web, in practical application in a separate drawing equipment, which does not only lead to the generation of thick and thin portions in the nonwoven web at predetermined repeatings, but which also enables both units contiguous to the drawing equipment to run at constant speeds. In this case the speed modulation that the cyclically operating drawing equipment generates in the nonwoven web is buffered by buffer or temporary storage means with respect to the units disposed upstream and downstream of said drawing equipment.

When in the drawing equipment the intake-sided roller of the drawing equipment rotates at constant speed corresponding to the constant output speed of the nonwoven producing means and the cyclic drawing is generated by cyclic acceleration and delay of the rotational speed of the outlet-sided roller of the drawing equipment, a buffer storing on the outlet side of the drawing equipment is provided which cyclically accommodates a partial section of variable length of the nonwoven web. If on the other hand the outlet-sided roller of the drawing equipment is driven at constant speed according to the constant nonwoven intake speed of the fleece laying machine and if the drawing process is carried out by cyclic braking and re-accelerating the inlet-sided roller of the drawing equipment, a buffer storing between the nonwoven producing means and the drawing equipment is provided. A combination of both is also possible.

According to an alternative embodiment, the use of a buffer storage can be dispensed with, if the units contiguous to the drawing equipment are driven at the same speeds as the adjoining rollers of the drawing equipment. This requires a corresponding modulation of the output speed of the carding machine or of the intake speed of the fleece laying machine.

According to a further alternative of the invention a buffer storage is provided between the drawing equipment and the fleece laying machine, and the fleece laying machine operates at a nonwoven intake speed that depends on the laying movements of its laying carriage. The aim of such a measure shall briefly be discussed here.

The laying carriage of a fleece laying machine carries out a reciprocating movement extending transversely to the laying belt on which the fleece web is produced by cross-lapped depositing the nonwoven. The reversal of movement at the end of each movement stroke is not carried out suddenly but during controlled braking and acceleration phases. If the nonwoven web is supplied at constant speed, thickenings in the deposited fleece web result due to these braking and acceleration phases exactly where the fleece web is actually to be thinner. Thus, known fleece laying machines are constructed in a manner that the laying carriage has a variable nonwoven transport speed, which requires the use of a buffer storage to synchronize the regular nonwoven intake speed of the supply belt of the fleece laying machine with the variable nonwoven transport speed of its laying carriage.

If the nonwoven intake speed of the supply belt is adapted to the nonwoven transport speed of the laying carriage, a buffer storage in the fleece laying machine can be renounced. The required buffer storing is performed according to this embodiment of the invention by the buffer storage provided between the drawing equipment and the fleece laying machine, said buffer storage being required for the compensation of the cyclically variable output speed of the drawing equipment anyway. If the buffer storage operates by using a movable storage roller or a reciprocating, continuously rotating nonwoven storage belt, the movement drive thereof must be controlled in accordance with the demands of the fleece laying machine and those of the drawing equipment.

The drawing equipment may be a multi-stage drawing equipment, wherein buffer storages may be arranged between the individual stages, said buffer storages allowing a relaxation of the nonwoven fibers that is advantageous in certain applications.

It is further advantageous if the working result is measured, and a feedback control of the drawing equipment is carried out on the basis thereof. For this purpose is the fleece web thickness detected transversely to the longitudinal extension of the fleece web, e.g. by the aid of radiometric, acoustic, optical or mechanical measuring means, and the output signals of these measuring means are used for affecting the drawing extent and the length of the drawing zones within the nonwoven web.

SHORT DESCRIPTION OF THE DRAWINGS

The invention will now be explained in detail with reference to an embodiment schematically shown in the drawings.

Figure 2:
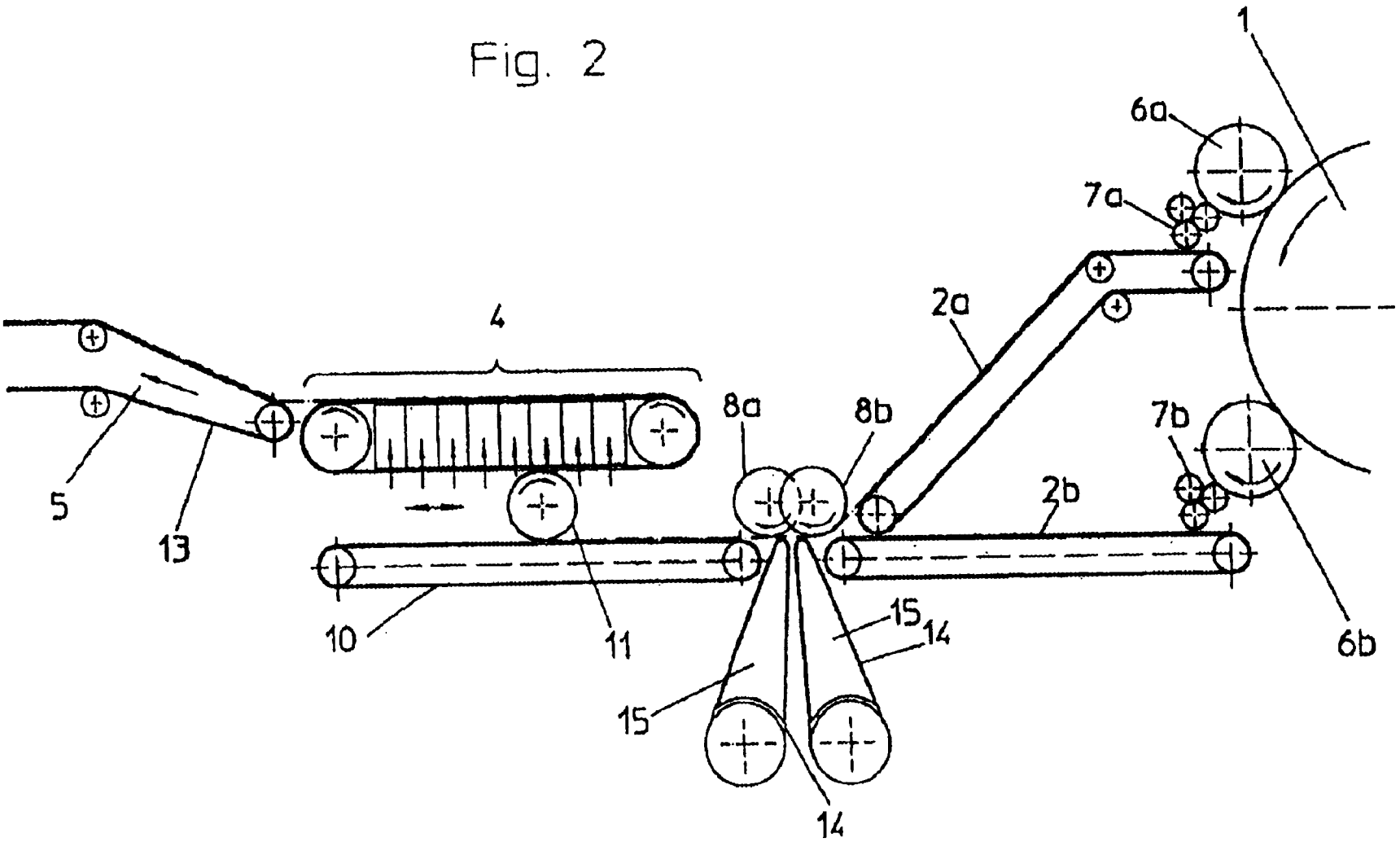
Figure 3A:
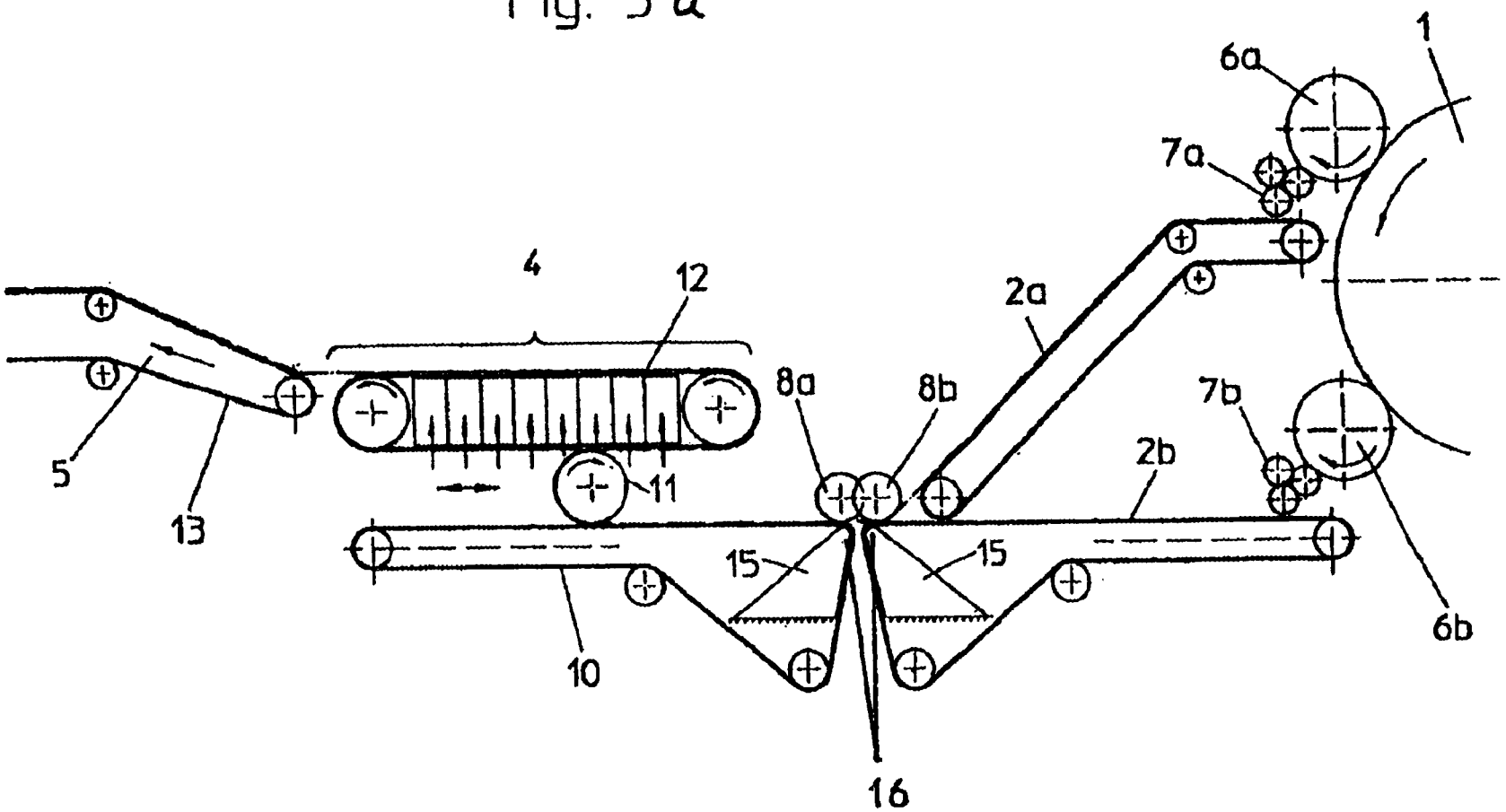
Figure 3B:
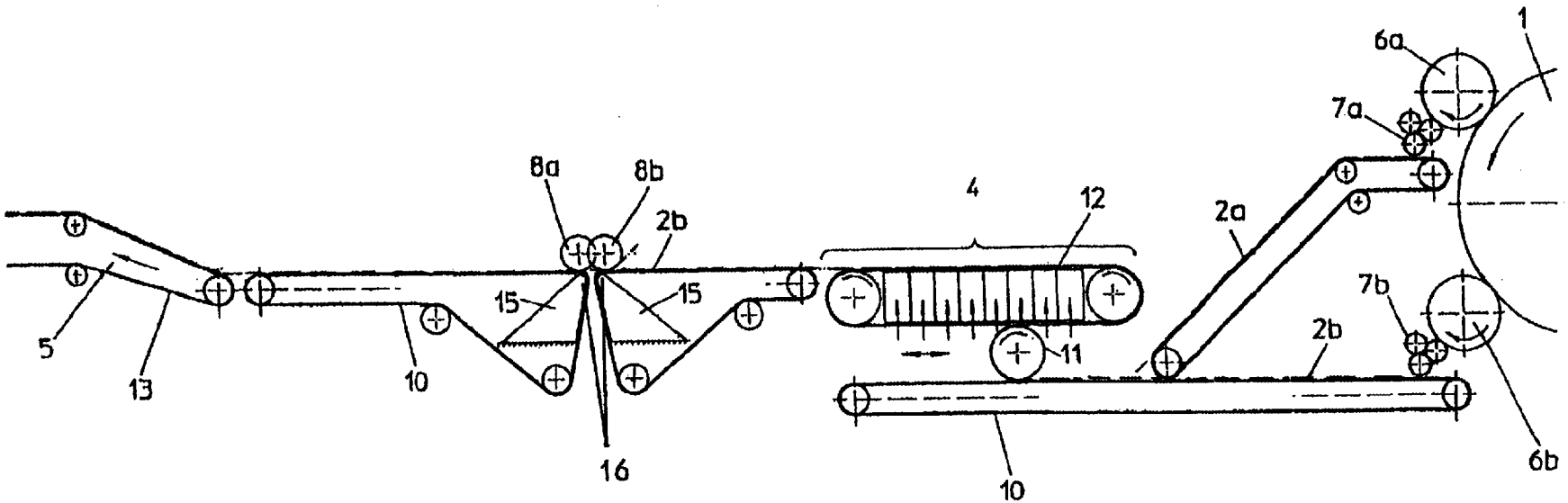
Figure 4:
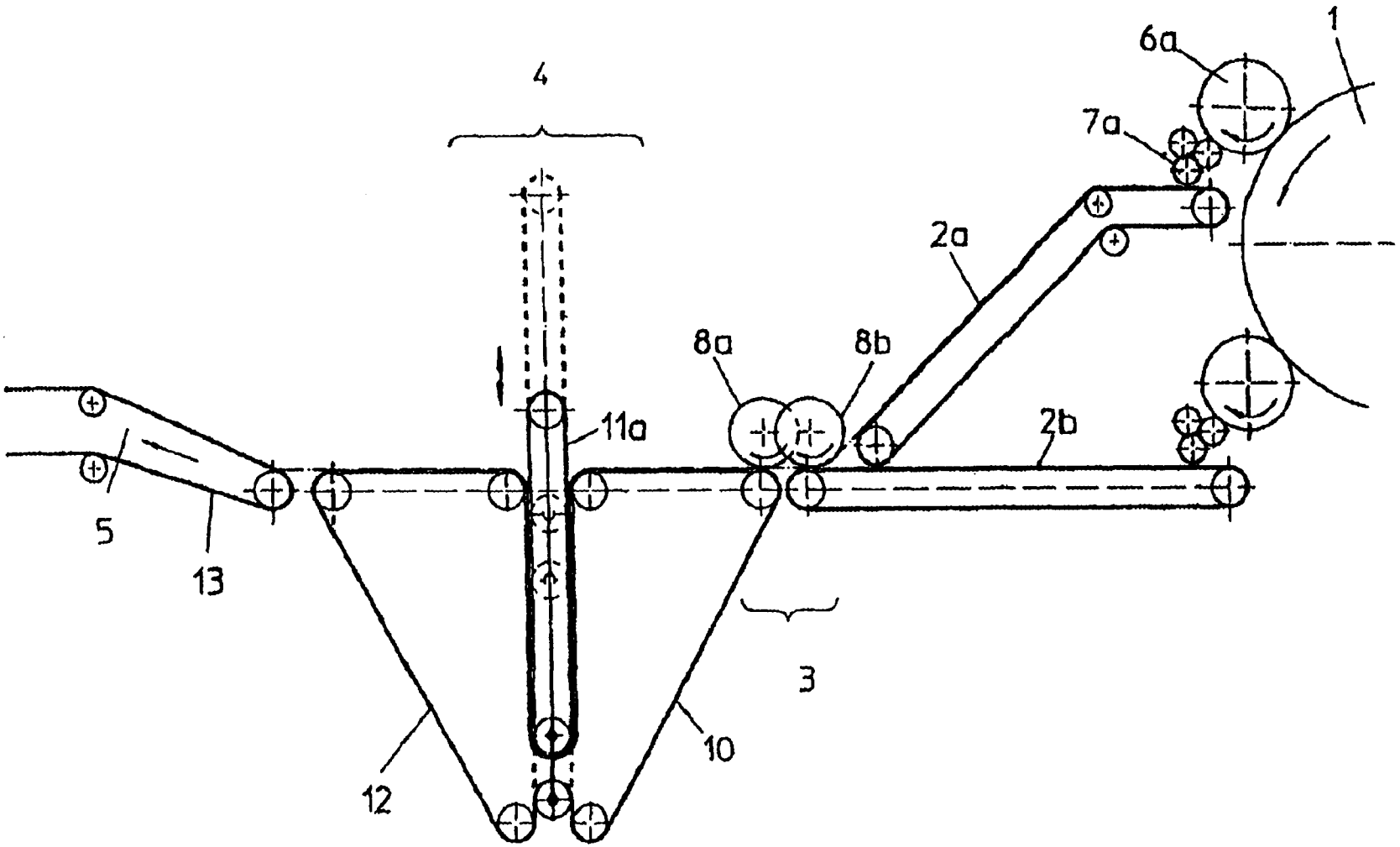

FIG. 1 is a schematic drawing of a first embodiment of a device according to the invention, FIG. 2 is a schematic drawing similar to FIG. 1 with a modified drawing equipment, FIG. 3*a* is a schematic drawing similar to FIG. 2 with a modified drawing equipment, FIG. 3*b* is a schematic drawing similar to FIG. 3*a* with a modified drawing equipment, and FIG. 4 is a schematic drawing similar to FIG. 1 with an alternative embodiment of a buffers storage.

DETAILED DESCRIPTION OF PREFERRED EMBODIMENTS

On the left side the drawings show the swift 1 of a carding machine, from which upper and lower transfer belts 2*a* and 2*b* extend to a drawing equipment 3 consisting of two disk rollers, to which said drawing equipment 3 a first intermediate belt 10 of a nonwoven storage 4 is connected downstream, which leads to the supply belt of a fleece laying machine 5. The drive means (motors) of carding machine swift, pick-up, outlet, drawing equipment, nonwoven storage and fleece laying machine are not shown for reasons of clarity.

The use of two transfer belts 2*a* and 2*b* is justified by the fact that the carding machine swift 1 has two pick-ups, namely an upper pick-up 6*a* with an outlet 7*a* and a lower pick-up 6*b* with an outlet 7*b*. Thus, two nonwoven webs are output by the carding machine, said nonwoven webs being doubled before the drawing process. The pick-ups and the outlets are conventional and do not have to be explained any further.

A particularity is the drawing equipment 3 for the double-layered nonwoven web supplied thereto. The drawing equipment 3 consists of a pair of disk rollers 8*a* and 8*b* each consisting of a plurality of matching parallel disks, wherein the axes 9*a* and 9*b* of the disc rollers 8*a* and 8*b* have a distance to each other that is smaller than the sum of radii of the disks. The disks of the disk rollers 8*a* and 8*b* are adjusted "to a gap", i.e. the disks of the one disk roller engage into the disk spaces of the other disk roller so that the disk rollers 8*a* and 8*b* penetrate each other. This measure allows to make the drawing zone short.

The mutual axis distance of the disk rollers 8*a* and 8*b* is preferably adjustable to adapt the length of the drawing zone to the properties of the nonwoven material actually processed, in particular the staple length of the nonwoven fibers.

Moreover, the drawing equipment 3 comprises supports opposing the disk rollers 8*a* and 8*b,* said supports being formed in the example of FIG. 1 by the lower transfer belt 2*b* and the first intermediate belt 10 of the nonwoven storage 4. Both belts may have an anti-slip surface so that there is sufficient friction between the disk rollers 8*a* and 8*b* and the supports formed by the belts 10 and 2*b* so that the nonwoven between the disk rollers 8*a* and 8*b* can be drawn longitudinally due to the difference between the circumferential speeds of the disk rollers 8*a* and 8*b.*

Furthermore, disk rollers and perforated rollers as well as travelling belts can be used as support for the nonwoven web in the area of the drawing rollers.

The use of disk rollers in the drawing equipment gives the drawing equipment special advantages. On the one hand is the nonwoven between the disk rollers and the support compressed. For this purpose it is required that the air contained in the nonwoven may escape from the nonwoven. The gaps between the disks of the disk rollers enable the basically unhindered escape of air from the nonwoven web. This escape may also be enhanced if the lower transfer belt 2*a* and possibly the intermediate belt 10 are formed as perforated belts. On the other hand, even if the disks have a relatively large disk diameter, drawing zone lengths may be attained which are smaller than the disk diameter.

As an alternative, perforated rollers may be used instead of disk rollers. However, disk rollers are the preferred rollers, since they have further advantages, namely the above-mentioned advantage that the distance between the clamping lines, formed by a disk roller and the opposing support, can be reduced as far as possible. This distance between the clamping line determines the length of the drawing zone, which in turn shall be chosen in accordance with the fiber length in the nonwoven and the fiber orientation. Thus, the distance between the axes of the two disk rollers 8*a* and 8*b* is also preferably adjustable.

If the drawing zone is to be very short, rollers of a correspondingly smaller diameter must be chosen so that the distance between the above-mentioned clamping lines becomes small. In this case, it may become necessary for stability reasons to support the rollers at several portions of their longitudinal extension at the side opposite to the drawing rollers.

If the support is a perforated belt, which is guided in the area of the associated drawing roller around a reversing roller, it may become necessary to support the reversing roller on its side opposite the drawing roller at a plurality of portions of its longitudinal extension to prevent a bending.

FIG. 2 shows a structure in which every support is formed by an endless perforated belt 14, which runs over a support structure 15, which in the area of the associated drawing roller 8*a* and 8*b,* respectively, has a reversing surface of a small radius of curvature. This support structure 15 consists at least in the area of the support surface facing the drawing roller of a plurality of ribs arranged adjacently in parallel, which form gaps between them, or it comprises a perforation ventilated towards the outside, into which air pressed out of the nonwoven when entering the gap between the drawing roller and the support can escape through the perforated web. Due to the small radii of curvature of the support structure 15 and the small diameters of the drawing rollers 8*a,* 8*b,* a very short drawing zone results which is suitable for the processing of fiber nonwovens having a short staple length of the fibers contained in the nonwoven. It is clear that corresponding supply and discharge belts for the nonwoven web are arranged in upstream and downstream of the supports.

An alternative for this shows FIG. 3*a*, according to which the nonwoven transport belt 2*b* and the intermediate belt 10 in the area of the drawing rollers 8*b* and 8*a*, shown with a relatively small diameter in this case, are guided over reversing edges 16 of a small radius of curvature, comparable to the embodiment according to FIG. 2. The support structure 15 for the reversing edges is comparable to that of FIG. 2 and preferably also comprises means for ventilating the nonwoven web. Due to the required support of these reversing edges, said belts must go a certain way round. In this solution, the separate perforated belts according to FIG. 2, which are running in the area of the drawing rollers only, are superfluous, and the additional gaps are also not required which must be bridged by the nonwoven web on its path in the area of the drawing equipment. The belts 2*b* and 10 are air-pervious, e.g. perforated belts, in order to enhance the escape of air out of the nonwoven web when compressing the nonwoven web. Both belts may be subjected to a vacuum pressure from their reverse side to support the mechanical compression of the nonwoven web, which is effected by the clamping device (not shown) especially installed for this purpose and in any case positively by the drawing equipment.

Advantageously is the distance between the disk rollers 8*a* and 8*b* and the opposing supports adjustable to adapt the heights of the gaps formed by them to the thickness of the nonwoven web.

A nonwoven temporary storage 4 is connected to the drawing equipment, said nonwoven temporary storage consisting of the already mentioned intermediate belt 10 on the downstream side of the drawing equipment 3, a nonwoven storage roller 11 and a second intermediate belt 12. The nonwoven storage roller 11 is encompassed by the nonwoven web. It supplies the nonwoven web to the lower side of a second intermediate belt 12 to which it is sucked on by a vacuum pressure effective from above and is thereby held. From the second intermediate belt 12 the nonwoven web reaches a supply or intake belt 13 of the fleece laying machine.

Within the nonwoven temporary storage 4, the nonwoven storage roller 11 is movable along the first intermediate belt 10 and the second intermediate belt 12. The length of the path that the nonwoven web must take between the outlet of the drawing equipment 3 and the inlet of the supply belt 13, is therefore variable by adjusting the nonwoven storage roller 11 along the intermediate belts 10 and 12. The variable buffer storage of the drawn nonwoven web is necessary to accommodate the nonwoven web at cycle times in which the outlet-sided disk roller 8*a* of the drawing equipment 3 runs faster than in the remaining times and to prevent upsetting of the nonwoven web in front of the supply belt 13 of the fleece laying machine 5.

As an alternative shown in FIG. 3B, the nonwoven storage 4 can be arranged at the inlet side of the drawing equipment 3, namely when the drawing process is performed at a constant speed of rotation of the outlet-sided disk roller 8*a* of the drawing equipment by cyclic braking of the inlet-sided disk roller 8*b*. In this case an upsetting of the nonwoven web discharged by the carding machine swift 1 in front of the drawing equipment is prevented.

During operation of the embodiment according to FIG. 1 of the device according to the invention, the double-layered nonwoven web supplied by the carding machine swift 1 runs through the drawing equipment. When reaching the drawing equipment 3, the air contained in the nonwoven web is substantially pressed out by compressing the nonwoven web, wherein it escapes into the gaps between the disks of the drawing rollers and possibly through the support. From the drawing equipment 3, the nonwoven web reaches the intermediate belt 10 of the nonwoven storage 4, it encompasses the nonwoven storage roller 11 and is sucked on to the section of the lower drum of the second intermediate belt 12 arranged right of the nonwoven storage roller 11, said intermediate belt 12 running in anti-clockwise direction at constant speed. The upper section of the second intermediate belt 12 supplies the nonwoven web to the intake belt 13 of the fleece laying machine 5.

Depending on the movements of the laying carriage (not shown) of the fleece laying machine 5 controlled by a control means (not shown), the outlet-sided drawing roller 8*a* of the drawing equipment and the first intermediate belt 10 are cyclically accelerated to a higher speed than the constant circumferential speed of the inlet-sided drawing roller 8*b*, and are subsequently braked to the original speed. Simultaneously with this acceleration does the nonwoven storage roller 11 perform a movement to the left to bring the increased speed by which the nonwoven web is transported by the first intermediate belt 10, to the constant running speed of the second intermediate belt 12. In other words, an upsetting of the nonwoven web is prevented. If subsequently the drawing roller 8*a* and the first intermediate belt 10 are being braked again, the nonwoven storage roller 11 will move to the right again to prevent a drawing of the nonwoven web.

The adaptation of the cyclic acceleration of the drawing roller 8*a* and of the first intermediate belt 10 to the laying movement of the fleece laying machine, takes the length of the travelling path of the nonwoven web between the drawing equipment 3 and the outlet portion of the fleece laying apparatus into consideration and is arranged in a manner that thin portions in the nonwoven web generated by the drawing equipment are deposited in the edge portion of the cross-lapped fleece web formed from the nonwoven web.

The speed at which the nonwoven web is received by the fleece laying machine 5 is constant, but due to the drawing of the nonwoven web, it is higher than the constant speed at which the nonwoven web enters the drawing equipment 3.

If a drawing of the nonwoven on the whole is desired, the circumferential basic speed of the outlet-sided drawing roller, from which the acceleration of the drawing roller takes place, can be set higher than the circumferential speed of the inlet-sided drawing roller.

At this point it must be emphasized that a compressing means may be arranged up-stream of the drawing equipment 3, said means mechanically compressing the nonwoven web, to press out the air contained therein. This is especially advantageous when the nonwoven web is voluminous and the ventilation effect in the drawing equipment is therefore possibly insufficient.

According to the drawings, the nonwoven web that is supplied to the drawing equipment, consists of two layers that were doubled. As an alternative, it is possible to pass one of the layers only through the cyclically operating drawing equipment, while the other layer is passed by this drawing equipment. However, it is necessary to constantly draw this other layer to a mean extent by which the first mentioned layer is drawn in the cyclically operating drawing equipment, since the speeds of both layers must be adapted to one another before the two layers are superimposed by the fleece laying machine.

The embodiment of the device according to FIG. 4 differs from the embodiment according to FIG. 1 by the construction of the nonwoven temporary storage 4. If the embodiment according to FIG. 1 requires a second intermediate belt 12 at which the nonwoven web is held by the effect of vacuum pressure, such vacuum pressure means can be renounced in the embodiment according to FIG. 4. Instead, both intermediate belts 10 and 12 each comprise a vertically guided section, and between those sections, an endlessly rotating storage belt 11*a* extends as a substitute of the storage roller 11 of FIG. 1, said belt being able to be adjusted in parallel to the vertical sections of the intermediate belts 10 and 12 to be able to store different lengths of the nonwoven web in the nonwoven storage. This storage belt 11*a* keeps the nonwoven web in engagement at both intermediate belts 10 and 12. The adjustment of the storage belt 11*a* is subject to the same laws that apply for the storage roller of the embodiment according to FIG. 1. An explanation in this respect can be renounced in order to avoid repetitions.

While the principles of the invention have been shown and described in connection with specific embodiments, it is to be understood that such embodiments are by way of example and are not limiting.

What is claimed is:

1. A method of manufacturing a fiber fleece by means of a nonwoven producing means and a fleece laying machine, which performs laying movements by means of which a fleece web having a thickness variable across a laying width is generated from a single or multi-layered nonwoven web continuously discharged at a constant speed by the nonwoven producing means, wherein a speed, at which the fleece laying machine takes in and deposits the nonwoven web is constant and the nonwoven web is longitudinally drawn in a drawing process on a path between the nonwoven producing means and the fleece laying machine cyclically in adaptation to the laying movements of the fleece laying machine, wherein a buffering of the nonwoven web is taking place in the path of the nonwoven web in one of (a) downstream the drawing process, to obtain an adaptation of fluctuations of the speed of the nonwoven web leaving the drawing process caused by the cyclic drawing process to a constant speed by which the nonwoven web drawn is taken in by the fleece laying machine, and (b) upstream the drawing process to obtain an adaptation of fluctuations of an intake speed of the nonwoven web into the drawing process caused by the cyclic drawing process to the constant speed by which the nonwoven web is supplied by the nonwoven producing means.

2. The method of claim 1 wherein the nonwoven web is drawn in a plurality of successively arranged stages.

3. The method of claim 1 wherein the nonwoven web has a thickness and is compressed before the drawing process in order to reduce its thickness.

4. The method of claim 1 wherein the nonwoven web consists of staple fibers that have a length and orientation, and wherein the drawing of the nonwoven web is carried out in a drawing zone having a length and the length of the drawing zone is adjusted depending on the staple length and the orientation of the fibers forming the nonwoven web.

5. A method of manufacturing a fiber fleece by means of a nonwoven producing means and a fleece laying machine, which performs laying movements by means of which a fleece web having a thickness variable across a laying width is generated from a single or multi-layered nonwoven web continuously discharged at a constant speed by the nonwoven producing means, wherein the nonwoven web is longitudinally drawn on a path between the nonwoven producing means and the fleece laying machine in a cyclically recurring drawing process in adaptation with the laying movements of the fleece laying machine, the nonwoven web is transported within the fleece laying machine without buffer storage within the fleece laying machine at a variable transport speed in adaptation to the laying movement, and after drawing of the nonwoven web before its transfer to the fleece laying machine a buffering of the nonwoven web takes place for adaptation of fluctuations of the nonwoven web speed caused by the cyclic drawing process to a transport speed of the fleece web within the fleece laying machine and for compensation of changes of the transport speed of the nonwoven web in the fleece laying machine.

6. The method of claim 5 wherein the nonwoven web is drawn in a plurality of successively arranged stages.

7. The method of claim 5 wherein the nonwoven web has a thickness and is compressed before the drawing process in order to reduce its thickness.

8. The method of claim 5 wherein the nonwoven web consists of staple fibers that have a length and orientation, and wherein the drawing of the nonwoven web is carried out in a drawing zone having a length and the length of the drawing zone is adjusted depending on the staple length and the orientation of the fibers forming the nonwoven web.

9. A method of manufacturing a fiber fleece by means of a nonwoven producing means and a fleece laying machine, which by the aid of laying movements generates a fleece web having a thickness variable across the laying width from a single or multi-layered nonwoven web continuously discharged by a nonwoven producing means at a constant speed, wherein the nonwoven web is longitudinally drawn on a path between the nonwoven producing means and the fleece laying machine in a cyclically recurrent drawing process in adaptation to the laying movements of the fleece laying machine, and a speed at which the fleece laying machine receives the nonwoven web is synchronized with a speed at which the nonwoven web leaves the drawing process.

10. The method of claim 9 wherein the nonwoven web is accelerated by the drawing process on a section arranged downstream of the drawing process.

11. The method of claim 10 wherein the nonwoven web is drawn in a plurality of successively arranged stages.

12. The method of claim 9 wherein the nonwoven web is drawn in a plurality of successively arranged stages.

13. The method of claim 9 wherein the nonwoven web has a thickness and is compressed before the drawing process in order to reduce its thickness.

14. The method of claim 9 wherein the nonwoven web consists of staple fibers that have a length and orientation, and wherein the drawing of the nonwoven web is carried out in a drawing zone having a length and the length of the drawing zone is adjusted depending on the staple length and the orientation of the fibers forming the nonwoven web.

15. A device for manufacturing a fiber fleece from a nonwoven web, which is discharged continuously by a nonwoven producing means at a constant speed, and a fleece laying machine to which the nonowoven web is supplied, wherein the fleece laying machine is driven at a constant nonwoven transport speed and performs laying movements, said device further comprising: a controllable drawing equipment, which is arranged between the nonwoven producing means and the fleece laying machine and through which the nonwoven web is passed, and which is adapted to draw the nonwoven web in a longitudinal direction, means acting onto the drawing equipment in the sense of a change of a drawing effect exerted onto the nonwoven web depending on the laying movements of the fleece laying machine, and buffer storage means, which are arranged at least on a side located upstream and downstream of the drawing equipment in vicinity to the drawing equipment.

16. The device of claim 15 wherein the drawing equipment comprises a plurality of drawing zones.

17. The device of claim 16 wherein a buffer storage for a section of the nonwoven web is arranged between the individual drawing zones.

18. The device of claim 15 wherein a compression means for compressing the nonwoven web is arranged between the nonwoven producing means and the drawing equipment.

19. A device for manufacturing a fiber fleece from a nonwoven web, which is continuously discharged by a nonwoven producing means at a constant speed, a fleece laying machine to which the nonwoven web is supplied and which carries out laying movements, wherein a controllable drawing equipment is arranged between the nonwoven producing means and the fleece laying machine through which the nonwoven web is passed and which is adapted to draw the nonwoven web in the longitudinal direction, the device further containing: means, which act on the drawing equipment in a sense of a cyclic change of a drawing effect exerted onto the nonwoven web depending on the laying movements of the fleece laying machine, and means, which synchronize a speed at which the fleece laying machine takes in the nonwoven at a speed at which the drawing equipment outputs the nonwoven to be drawn.

20. The device of claim 19 wherein the drawing equipment comprises a plurality of drawing zones.

21. The device of claim 20 wherein a buffer storage for a section of the nonwoven web is arranged between the individual drawing zones.

22. The device of claim 19 wherein a compression means for compressing the nonwoven web is arranged between the nonwoven producing means and the drawing equipment.

23. Drawing apparatus for drawing a nonwoven web, the drawing apparatus comprising at least two disk draw rollers arranged in parallel to each other, each disk draw rollers comprising a plurality of disks arranged in mutually spaced distances, thereby forming gaps between adjacent disks, the mutual distance of said disk draw rollers being adapted such that the disks of the one disk draw rollers project into the gaps between the disks of the other disk draw rollers, wherein supports are arranged opposite to each of the disk draw rollers, each support forming a gap with the respective disk draw roller though which the nonwoven web is passed and compressed thereby, each support being selected from a group that comprises a rubber belt, a perforated belt, a perforated roller, and a supporting disk roller, and the disk draw rollers have circumferential speeds that cyclically have a difference in a nonwoven passing direction.

24. The drawing apparatus of claim 23 adapted to cyclically change the difference of the circumferential speeds of the disk draw rollers in adaptation with the laying movement of a fleece laying machine.

25. The drawing apparatus of claim 23 wherein adjacent disk draw rollers are adjustably spaced from one another.

26. The drawing apparatus of claim 23 wherein the distance between each disk draw roller and the respective oppositely arranged support is adjustable.

* * * * *